United States Patent [19]

Hofmann

[11] Patent Number: 4,707,158

[45] Date of Patent: Nov. 17, 1987

[54] TRACTOR FEED FOR MARGIN PERFORATED PAPER WEBS

[75] Inventor: Norbert Hofmann, Nuremberg, Fed. Rep. of Germany

[73] Assignee: Ta Triumph-Adler A.G., Nuremberg, Fed. Rep. of Germany

[21] Appl. No.: 8,861

[22] Filed: Jan. 30, 1987

[30] Foreign Application Priority Data

Feb. 7, 1986 [DE] Fed. Rep. of Germany ..... 3603815

[51] Int. Cl.[4] ..... B41J 11/34

[52] U.S. Cl. ..... 400/616.2; 400/616.1; 226/170; 226/171; 226/74

[58] Field of Search ..... 400/616, 616.1, 616.2; 226/74, 75, 170, 171, 6

[56] References Cited

U.S. PATENT DOCUMENTS

| | | | |
|---|---|---|---|
| 438,529 | 10/1890 | Cox | 226/171 |
| 3,120,017 | 2/1964 | Ciaccio | 226/171 |
| 4,428,519 | 1/1984 | Reichl et al. | 226/170 |
| 4,453,660 | 6/1984 | Cornell et al. | 226/74 |
| 4,462,531 | 7/1984 | Seitz | 226/74 |

FOREIGN PATENT DOCUMENTS 2514506 10/1976 Fed. Rep. of Germany ... 400/616.1

*Primary Examiner*—Edgar S. Burr
*Assistant Examiner*—Joseph McCarthy
*Attorney, Agent, or Firm*—Browdy & Neimark

[57] ABSTRACT

A tractor feed for paper webs with margin perforation for use in printers of data processing systems in which endless bands support feed pins engagable with said perforations to effect paper transport toward, around and away from a platen. Upper and lower runs of the endless band and feed pins supported thereby are selectively adjustably movable into and out of paper guide slots to facilitate introduction and loading of the paper web. The band is movable by movable upper and lower guide rails which are controlled by an adjusting mechanism and by springs acting to spread said guide rails apart.

4 Claims, 3 Drawing Figures

TRACTOR FEED FOR MARGIN PERFORATED PAPER WEBS

BACKGROUND OF THE INVENTION

1. Field of the Invention

The invention relates to a tractor feed for paper webs with margin perforations for use in printers of data processing systems; more particularly, it relates to a tractor feed having endless band supported feed pins adapted to be manipulated to allow introduction and loading of a paper web and to engage and feed paper webs toward, around and away from a printing platen under the control of movable band guide rails.

2. Description of Related Art

In known tractor feed devices, the paper web is often guided to a platen by means of one pin feed band section and transported away from it by means of the other section, as in e.g. DE-A1 No. 30 46 592 or DE-AS No. 22 33 095. This means that the paper web passes through the tractor pair on top and bottom. This causes particular difficulties when introducing a new paper web. It is for this reason that in relatively flat printer housings the tractors are pivotably mounted to provide access to the underside of the tractor feed. This increases the cost of a printer considerably. To be able to insert the paper into the pins of the band, pivotable guide strips and associated springs are necessary to see to it that they remain in their open position. This makes the known tractor feeds hard to assemble and to handle.

SUMMARY OF THE INVENTION

In accordance with the invention, a tractor feed is provided wherein endless band supporting pins are movable into and out of paper guide slots by movement of band guide rails to facilitate paper introduction and paper feeding toward, around and away from a platen.

An object of the invention is in the provision of a tractor feed which enables a simpler printer design and easy handling when loading a paper web.

Another object of the invention is to make it possible to move the feed pins of the driving bands out of the paper guiding slots so that the paper can be introduced and loaded into the guide slots in transport direction without a pivotal movement of band guide rails.

Another object of the invention is in the provision of a tractor feed wherein, after insertion into one of upper and lower guide slots, the paper web can be grabbed by some of the pins while others of the pins are still outside of the other guide slot thereby to enable the paper web to be advanced toward and around the platen by power drive.

A further object of the invention is in the provision of means for biasing feed pins toward paper web guide slots, so that the feed pins can locate and engage perforations when they do not coincide by positioning the paper.

Other objects, features and advantages of the present invention will become better known to those skilled in the art from a reading of the following detailed description when taken in conjunction with the accompanying drawing wherein like reference numerals designate like or corresponding elements throughout the several views thereof and wherein:

DESCRIPTION OF THE EMBODIMENT

Figure 1:
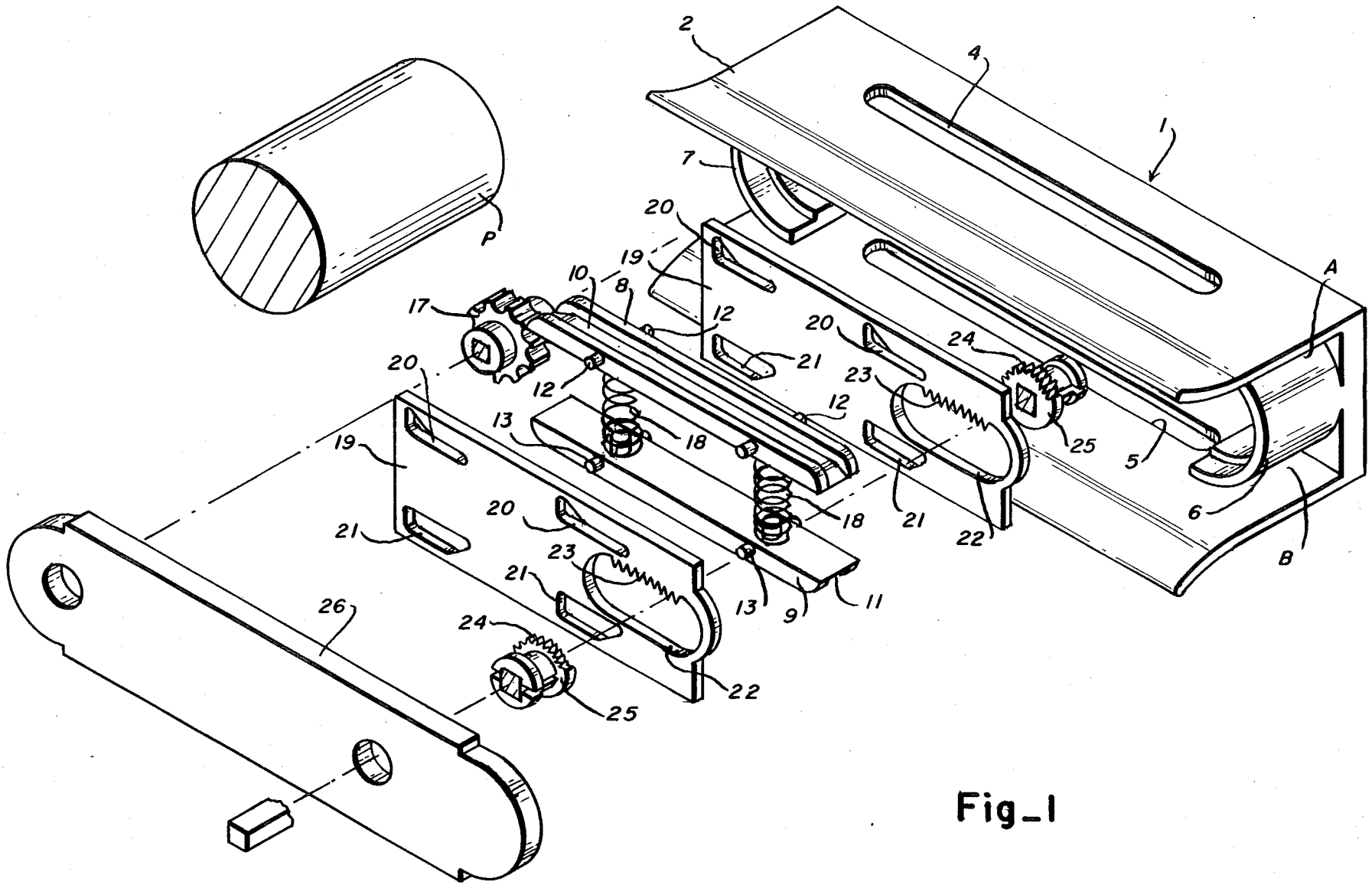
FIG. 1 is an exploded perspective view of the individual components of the tractor feed of the invention.

Referring now to the drawing, there is shown in FIG. 1 a housing of one of a pair of tractor feeds each adapted to drive one edge of a perforated web. The housing 1 has a U-shaped cross-section with the legs of the U extending horizontally, forming upper and lower paper guiding strips 2 and 3 each having a longitudinal slot 4 and 5 respectively. Disposed at the two housing ends are curved guides 6 and 7 which are yet to be discussed. The paper guiding strips 2 and 3 together with the guides 6 and 7 define between them upper and lower paper guiding slots A and B.

Figure 2:
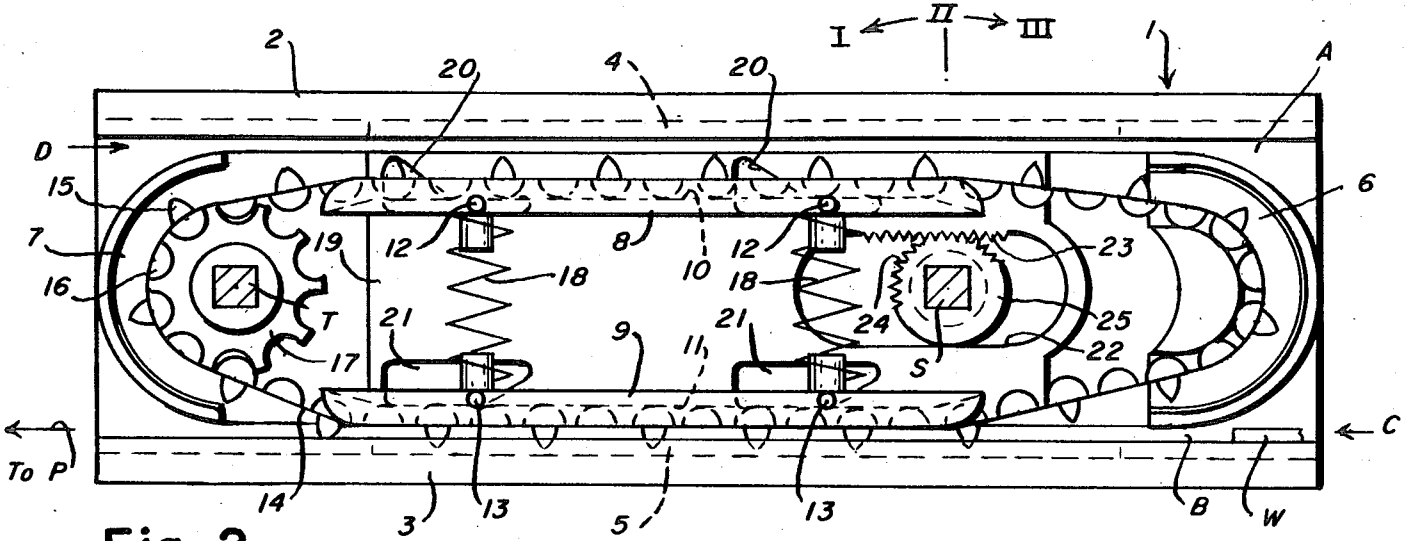
FIG. 2 is a side view looking left to right in FIG. 1 of the tractor feed in a paper loading position with the housing cover plate and a sliding block removed.

In assembly, band guide rails 8 and 9, provided with guide grooves 10 and 11 respectively and pins 12 and 13 respectively extending to either side, are adapted to be positioned in the longitudinal plane of the slots 4 and 5. As shown in FIG. 2 an endless band 14 is trained about a semi-circular portion of guide 6 and a drive gear within guide 7 and is adapted to slide in guide slots 10 and 11 therebetween. The band 14 has on its outer side outwardly directed feed pins 15 at equally spaced intervals and on the inside, nubs 16 which serve as friction reducing sliders, and also to engage a gear 17 drivable by means of a square drive shaft T to transport the band 14. As may be seen from FIG. 2, nub 16 are provided opposite every other feed pin 15. This band design is one in common use. The guide rails 8 and 9 are formed to locate between them springs 18 which tend to spread the guide rails 8 and 9 apart.

As shown in FIG. 1, there are provided for mounting in the housing laterally to either side of the guide rails 8 and 9, sliding blocks 19 with pairs of upper and lower cam slots 20 and 21 into which pins 12 and 13 of the guide rails 8 and 9 extend. In the embodiment shown, cam slots 20 differ in form from those designated 21 and are designed as best shown in FIG. 2, so that when the sliding blocks are moved the cams 20, 21 will act on pins 12 and 13 to move the guide rails 8 and 9 relative to one another at different times. The design of the cam slots 20 and 21 thus determines the temporal motion cycle of the guide rails 8 and 9 and, hence, of the penetration of feed pins 15 on band areas riding the guide rails 8 and 9 into guide slots A and B.

Each of the sliding blocks 19 is also provided with an elongated hole 22 with a longitudinal rack 23 machined into the upper edge of the holes 22. Each rack 23 is adapted to mesh with an associated gear segment 24 of a wheel 25 provided to move the associated sliding blocks 19. Both wheels 25 are slidably mounted on a square shafts S. This makes it possible to adjust the spacing between a pair of tractor feeds to the width of the perforated paper web. A cover plate 26 serves to close housing 1 of the tractor feed.

The tractor feed is constructed so that it can be assembled for use and serve either the right-hand or left-hand perforations of a paper web. It only must be seen to it that for one the sliding blocks 19 and wheels 25 are arranged as shown in the drawing, while for the other the sliding blocks 19 must be assembled turned about their longitudinal axis by 180°. If the wheels 25 have no revolving face gear, they must also be installed turned by 180° so that the gear segment 24 can again mesh with the longitudinal rack 23. The toothless face of the wheels 25 act as guides for the sliding blocks 19. Thus, all parts are identical parts, which makes it possible to produce them at particularly low cost.

The various components are assembled by plugging them into each other in turn from the left toward the right as viewed to FIG. 1. If the assembled transport device is then pushed over the square shaft S and T, it is ready for use. The bands 14 and pins 15 are transported by means of the shaft T supporting the gears 17. The other square shaft S serves the adjustment of the sliding blocks 19. For this purpose, shaft S may have at one end an adjusting lever which may be lockable. It is yet noted that virtually all parts except the springs 18 and the shafts can be made of plastic. This fact also contributes substantially to cost reduction.

Figure 3:
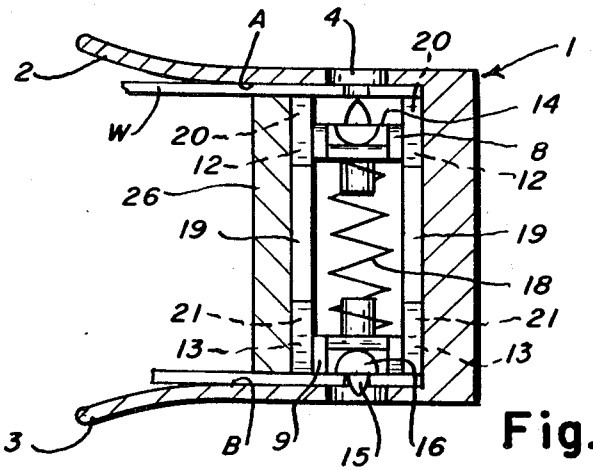
FIG. 3 is an end view of the tractor feed as shown in FIG. 2.

The transport device described functions as follows:

If the tractor feed is in a position II, wherein the pins 15 opposite the upper band guide 10 are retracted and the pins 15 opposite the lower guide 9 extend into guide slot B as shown in FIGS. 2 and 3 and a new a paper web W is to be loaded, this requires first moving the sliding blocks 19 to the left into a position I. The just described change of position of the sliding blocks 19 to the position I can be accomplished by turning an adjusting lever on square shaft S. With reference to FIG. 2, this leftward movement of the sliding blocks 19 from position II to position I causes the angled surface of the cam slots 21 acting on pins 13 to move the lower guide rail 9 upwardly counter to the spring forces. This movement from position II to position I does not affect the position of the upper guide rail 10 since slot 20 does not move pin 12. Thus, in position I, feed pins 15 would be retracted from both guide slots A and B.

With feed pins 15 retracted from guide slots A and B, paper web W can now be introduced into the paper guide slot B in the direction of arrow C, e.g., until the front edge of the web W comes out on the exit side of guide slot B. Now the adjusting lever mentioned is brought into its position II as shown thus causing the lower guide rail 9 and the feed pins 15 opposite to penetrate guide slot B and to engage the margin perforations of the introduced paper web W. If perforations and pins 15 do not coincide, the paper web W can be pulled until the springs 18 push the feed pins 15 into the paper perforations by means of the guide rail 9.

From then on the paper web can be moved toward the platen P by power drive in response to operator depression of an appropriate key. When the paper web W has been led around the platen and possibly also past an end-of-paper signaling device, its front edge arrives at and is entered into the upper paper guiding slot A in arrow direction D. After the paper web has been introduced into the paper guiding slot A, the aforementioned adjusting lever and shaft S are turned to bring sliding block into a position III, i.e. sliding blocks 19 are moved to the right beyond position II. In position III the sliding blocks are so positioned that springs 18 can act on both guide rails 8 and 9 whereby feed pins 15 can penetrate both guide slots A and B and engage perforations aligned therewith. If they do not coincide, the paper web can be tightened by pulling on it so that the springs 18 can become effective to effect engagement. This concludes the paper loading operation. Other than rotation of shafts S and T, nothing has to be pivoted, and handling is easy even when, e.g. in a flat printer housing, the tractor feed is disposed close to a housing base plate.

The stroke of the feed pins 15 opposite the guide rails 8 and 9 is such that, in the retracted position of the pins 15, they clear the paper guide slot A or B completely. In their extended position, however, the tips of the pins 15 project into the longitudinal slots 4 and 5 of the paper guiding strips 2 and 3 to prevent, in the event of a possible slack in the paper web, disengagement of the paper web from feed pins 15.

The band 14 can be produced in a length so that, when the feed pins 15 are retracted as described, it has a certain slack relative to the guide 6 and the drive gear 17 without trouble occuring. The slack is removed when the pins 15 are extended into the guide slots A and B. The guide 6 may, of course, also be mounted in a slot. It would then make sense to provide a spring tending to push the guide 6 outwardly so that the band 14 is always taut.

Instead of springs 18, spring fingers molded integrally to the guide rails 8 and 9 could be provided. Thus, various equivalent designs are imaginable. The proper design will be made dependent on the printer in which the tractor feeds will be used. The speed at which the printer operates will be particularly decisive because it is also governing the paper trnsport speed.

In cases in which paper tension which may be encountered is such that the guide rails 8 and 9 will be pushed toward one another, countering the force of the springs 18, cams could be provided on the wheels 25 to hug the inner long edge of the guide rails 8, 9 so as to lock the latter when the feed pins 15 are in their extended position.

The invention claimed is:

1. A tractor feed for use in printers having paper webs with margin perforations having a housing defining upper and lower said tractor feed paper guide slots, an endless band supporting feed pins for entry into said guide slots and for engagement with said perforations of a paper web introduced into said guide slots to cause the paper to be transported toward, around and away from a platen, and upper and lower band guide rails, the improvement comprising:

spring means urging said upper and lower guide rails apart and toward said band, laterally disposed pins carried by each of said guide rails and mounting said guide rails for selective movement toward and away from one another, a sliding block having cam slots into which said laterally disposed pins extend, said cam slots being shaped to selectively cause entry of said feed pins into either only said upper, paper guide slot or both of said paper guide slots, and means for moving said sliding block, whereby movement of said sliding block causes movement of said guide rails.

2. A tractor feed as recited in claim 1;

said cam slots being arranged so that first one and then the other guide rail is movable incident to movement of said sliding block.

3. A tractor feed as recited in claim 2, including a drive gear segment, and said sliding block having a longitudinal rack engageable by said gear segment and adjustably movable thereby.

4. A tractor feed as recited in claim 3, including means for rotating said gear segment to positions which allow introduction of a paper web, and to effect engagement of said feed pins therewith.

* * * * *